US011312918B2

(12) United States Patent
Schwaebisch et al.

(10) Patent No.: US 11,312,918 B2
(45) Date of Patent: Apr. 26, 2022

(54) TRANSMISSION FLUID COMPOSITION FOR IMPROVED WEAR PROTECTION

(71) Applicant: Infineum International Limited, Abingdon (GB)

(72) Inventors: Dirk Schwaebisch, Oxford (GB); David Gillot, Thatcham (GB)

(73) Assignee: Infineum International Limited, Abingdon (GB)

( * ) Notice: Subject to any disclaimer, the term of this patent is extended or adjusted under 35 U.S.C. 154(b) by 0 days.

(21) Appl. No.: 16/871,625

(22) Filed: May 11, 2020

(65) Prior Publication Data

US 2020/0354647 A1 Nov. 12, 2020

(30) Foreign Application Priority Data

May 9, 2019 (EP) ..... 19173561

(51) Int. Cl.

| | |
|---|---|
| ***C10M 105/72*** | (2006.01) |
| ***C10M 135/02*** | (2006.01) |
| ***C10M 169/04*** | (2006.01) |
| ***C10M 101/00*** | (2006.01) |
| ***C10M 135/10*** | (2006.01) |
| ***C10M 135/20*** | (2006.01) |
| ***C10M 137/10*** | (2006.01) |
| *C10N 40/04* | (2006.01) |
| *C10N 10/04* | (2006.01) |
| *C10N 10/12* | (2006.01) |
| *C10N 20/02* | (2006.01) |
| *C10N 30/04* | (2006.01) |
| *C10N 30/06* | (2006.01) |

(52) U.S. Cl.

CPC ..... *C10M 169/044* (2013.01); *C10M 101/00* (2013.01); *C10M 135/10* (2013.01); *C10M 135/20* (2013.01); *C10M 137/10* (2013.01); *C10N 2010/04* (2013.01); *C10N 2010/12* (2013.01); *C10N 2020/02* (2013.01); *C10N 2030/04* (2013.01); *C10N 2030/06* (2013.01); *C10N 2040/044* (2020.05)

(58) Field of Classification Search

CPC ..... C10M 135/10; C10M 135/20; C10M 137/10; C10M 2207/262; C10M 2219/064; C10M 2223/047; C10M 2219/084; C10M 2223/045; C10M 2223/049; C10M 2223/04; C10M 141/10; C10M 137/04; C10M 135/24; C10N 2040/044; C10N 2020/02; C10N 2030/06

USPC ..... 508/324

See application file for complete search history.

(56) References Cited

U.S. PATENT DOCUMENTS

| | | | | |
|---|---|---|---|---|
| 2,719,125 | A | 9/1955 | Roberts | |
| 2,719,126 | A | 9/1955 | Fields et al. | |
| 2,760,933 | A | 8/1956 | Fields et al. | |
| 2,836,564 | A | 5/1958 | Roberts et al. | |
| 3,087,937 | A | 4/1963 | Tesi et al. | |
| 3,254,025 | A | 5/1966 | Le Suer | |
| 3,502,677 | A | 3/1970 | Le Suer | |
| 3,663,561 | A | 5/1972 | Blaha | |
| 4,259,194 | A | 3/1981 | deVries et al. | |
| 4,259,195 | A | 3/1981 | King et al. | |
| 4,261,843 | A | 4/1981 | King et al. | |
| 4,263,152 | A | 4/1981 | King et al. | |
| 4,265,773 | A | 5/1981 | deVries et al. | |
| 4,272,387 | A | 6/1981 | King et al. | |
| 4,283,295 | A | 8/1981 | deVries et al. | |
| 4,285,822 | A | 8/1981 | deVries et al. | |
| 4,857,214 | A | 8/1989 | Papay et al. | |
| 4,873,009 | A | 10/1989 | Anderson | |
| 5,840,663 | A * | 11/1998 | Nibert | C10M 141/10 508/279 |
| 2009/0005277 | A1 | 1/2009 | Watts et al. | |
| 2018/0023019 | A1* | 1/2018 | Guiducci | C10M 105/00 508/186 |

FOREIGN PATENT DOCUMENTS

WO 94/06897 A1 3/1994

OTHER PUBLICATIONS

American Petroleum Institute (API) publication "Engine Oil Licensing and Certification System", Industry Services Department, Fourteenth Edition, Dec. 1996, Addendum 1, Dec. 1996.

Smallheer, C.V., Kennedy Smith, R., "Lubricant Additives", The Lezius-Hiles Co., 1967, pp. 1-11.

* cited by examiner

*Primary Examiner* — Prem C Singh
*Assistant Examiner* — Francis C Campanell
(74) *Attorney, Agent, or Firm* — David M. Weisberg

(57) ABSTRACT

A transmission fluid composition contains a major amount of a lubricating oil basestock, and a minor amount of an additive package comprising: (i) a mixture comprising two or more phosphites and/or phosphates; (ii) one or more thioester compounds; (iii) one or more zinc dihydrocarbyl dithiophosphate compounds; and (iv) one or more oil-soluble or dispersible molybdenum-containing compounds. Such a transmission fluid may be used for controlling and/or reducing wear, e.g., in a manual transmission.

20 Claims, No Drawings

TRANSMISSION FLUID COMPOSITION FOR IMPROVED WEAR PROTECTION

FIELD

This disclosure relates to lubricants, such as those for manual transmissions. The lubricants may provide wear protection to the contacting mechanical parts of the transmission while also providing the necessary frictional properties to enable efficient operation of the transmission.

BACKGROUND

The effective lubrication of a manual transmission, such as those found in passenger cars and other vehicles, relies on the use of a lubricant capable of meeting certain performance characteristics. The lubricant should provide wear protection to the contacting mechanical parts (e.g., the gears) and at the same time provide frictional properties to permit smooth and efficient gear shifting.

The gears in a manual transmission transfer the power from the vehicle engine to the drive-train, and are therefore placed under considerable load. The pressure in the contacts between meshing gear teeth can be high, and, without adequate protection from the lubricant, damaging wear of the gear surfaces can arise.

Efficient gear shifting in manual transmissions is normally achieved by the use of a synchroniser. The synchroniser can bring the drive shaft and the gear to be engaged into a position where the gear can be meshed. This can be achieved by reducing the relative velocity of the meshing parts to essentially zero. Attempting to shift gears when the relative velocity of the meshing parts is substantially non-zero often results in a noisy gear shift, as the meshing parts clash. For the synchroniser to achieve an essentially zero relative velocity between the meshing parts, the dynamic coefficient of friction between the parts should remain above a certain critical value. One function of the lubricant can be to control the dynamic coefficient of friction between the meshing parts. A lubricant that cannot maintain the dynamic coefficient of friction above a given threshold value will have difficulty in achieving essentially zero relative velocity of the meshing parts, thereby rendering shifting noisy, difficult, and/or inefficient.

It is thus important for a lubricant used in a manual transmission to be able to provide sufficient wear protection and good frictional properties. The present disclosure combines specific chemical additives to give a lubricating composition that can provide the necessary properties.

SUMMARY

Accordingly, the present disclosure provides a transmission fluid composition comprising a major amount of a lubricating oil basestock, and a minor amount of an additive package comprising:

(i) a mixture comprising two or more compounds of structures (I):

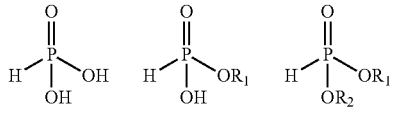

(I)

-continued

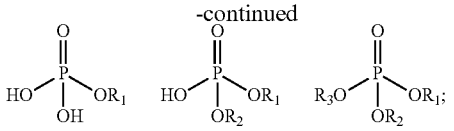

(ii) one or more compounds of structures (II):

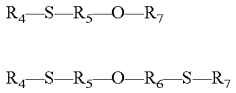

(II)

(iii) one or more zinc dihydrocarbyl dithiophosphate compounds; and (iv) one or more oil-soluble or dispersible molybdenum-containing compounds.

In structures (I), groups $R_1$, $R_2$, and $R_3$ (as applicable) may each independently be alkyl groups having 1 to 18 carbon atoms or alkyl groups having 1 to 18 carbon atoms where the alkyl chain is interrupted by a thioether linkage. In particular, in the mixture (i), at least some of groups $R_1$, $R_2$, and $R_3$ (as applicable) are alkyl groups having 1 to 18 carbon atoms where the alkyl chain is interrupted by a thioether linkage. In structures (11), groups $R_4$ and $R_7$ may each independently comprise or be alkyl groups having 1 to 12 carbon atoms, and groups $R_5$ and $R_6$ may each independently comprise or be alkyl linkages having 2 to 12 carbon atoms.

DETAILED DESCRIPTION

It has been found that the specific combination of components (i), (ii), (iii), and (iv) can provide wear protection, which may not obtainable when one or more of components (i), (ii), (iii), and (iv) is absent.

It is known in the art that compounds contain phosphorus can provide wear protection to highly-loaded contacting metal surfaces. Without being bound by theory, this has been suggested to be the result of the formation of a phosphite 'glass' on a lubricated metal surface. In the present disclosure, components (i) and (iii) both contain phosphorus, so either may be expected to provide similar wear protection. Nevertheless, according to the present disclosure, both components (i) and (iii) are believed to be needed for particularly advantageous wear protection. Furthermore, it has surprisingly been found that the combination of components (i), (ii), (iii), and (iv) can provide particularly enhanced wear protection. The experiments reported hereinbelow show that, when the total concentration of phosphorus is held constant, the combination of components (i), (ii), (iii), and (iv) can provide greater wear protection (as reflected average wear scar from the 4-ball wear test) than any component individually, than any combination of components (i) and (ii) alone, of components (i) and (iii) alone, of components (i) and (iv) alone, of components (ii) and (iii) alone, of components (ii) and (iv) alone, or of components (iii) and (iv) alone, and than any combination of components (i), (ii), and (iii), of components (i), (ii), and (iv), of components (i), (iii), and (iv), or of components (ii), (iii), and (iv). Again, without being bound by theory, there appears to be a synergistic interaction between the two phosphorus-containing components (i) and (iii), which interestingly seems only to be evident when the molybdenum compound (iv) is also present.

Component (i) may advantageously comprise a mixture of two or more compounds of the structures (I):

(I)

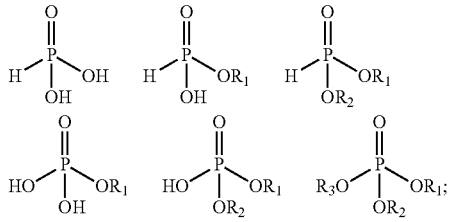

where groups $R_1$, $R_2$, and $R_3$ may each independently comprise or be alkyl groups having 1 to 18 carbon atoms and/or alkyl groups having 1 to 18 carbon atoms where the alkyl chain is interrupted by a thioether linkage, with the proviso that at least some of groups $R_1$, $R_2$, and $R_3$ may comprise or be alkyl groups having 1 to 18 carbon atoms where the alkyl chain is interrupted by a thioether linkage. The mixture may comprise three or more, four or more, or five or more compounds of the structures (1).

In some embodiments, groups $R_1$, $R_2$, and $R_3$ may each independently comprise or be alkyl groups having 4 to 10 carbon atoms and/or alkyl groups having 4 to 10 carbon atoms where the alkyl chain is interrupted by a thioether linkage, with the proviso that at least some of groups $R_1$, $R_2$, and $R_3$ may comprise or be alkyl groups having 4 to 10 carbon atoms where the alkyl chain is interrupted by a thioether linkage.

When groups $R_1$, $R_2$, and $R_3$ comprise alkyl groups (in which the alkyl chain is not interrupted by a thioether linkage), examples may include but are not limited to methyl, ethyl, propyl, and butyl, in particular including or being butyl.

When groups $R_1$, $R_2$, and $R_3$ comprise alkyl groups where the alkyl chain is interrupted by a thioether linkage, examples include groups of the structure —R'—S—R" where R' may be $—(CH_2)_n—$, in which n may be an integer from 2 to 4, and where R" may be $—(CH_2)_m—CH_3$, in which m may be an integer from 1 to 17, such as from 3 to 9.

In particular, in the mixture of compounds of structure (I) comprising component (i), at least 10% (e.g., at least 20%, at least 30%, or at least 40%) by mass of the mixture comprises compounds of structure (I) in which at least one of $R_1$, $R_2$, and $R_3$ comprises or is an alkyl group where the alkyl chain is interrupted by a thioether linkage, particularly having the structure —R'—S—R", where R' may be $—(CH_2)_n—$, in which n may be an integer from 2 to 4, and where R" may be $—(CH_2)_m—CH_3$, in which m may be an integer from 1 to 17, such as from 3 to 9.

Component (ii) may advantageously comprise one or more compounds of structures (II):

$$R_4—S—R_5—O—R_7$$

$$R_4—S—R_5—O—R_6—S—R_7 \quad \text{(II)}$$

where groups $R_4$ and $R_7$ may each independently comprise or be alkyl groups having 1 to 12 carbon atoms, and where $R_5$ and $R_6$ may each independently comprise or be alkyl linkages having 2 to 12 carbon atoms. In particular, $R_4$ and $R_7$ may each independently comprise or be $—(CH_2)_m—CH_3$, where m is an integer from 1 to 17, such as from 3 to 9, and $R_5$ and $R_6$ may each independently comprise or be $—(CH_2)_n—$, where n is an integer from 2 to 4. The mixture may comprise two or more or three or more compounds of the structures (II).

In particular, compounds of structure (I) (Component (i)) and compounds of structure (II) (Component (ii)) may each be present in the transmission fluid composition in an amount from 0.1 to 2.0% by mass, based on the total mass of the composition, from 0.1 to 1.2% by mass, from 0.1 to 0.8% by mass, or from 0.2 to 0.6% by mass. Additionally or alternatively, in particular, compounds of structure (I) (Component (i)) and compounds of structure (II) (Component (ii)) may collectively provide the transmission fluid composition with from 80 to 1000 parts per million by mass of phosphorous, based on the total mass of the composition, from 100 to 800 ppm, from 150 to 700 ppm, or from 200 to 600 ppm. Phosphorus content can be measured in accordance with ASTM D5185. Further additionally or alternatively, in particular, a mass ratio of compounds of structure (1) (Component (i)) and compounds of structure (II)(Component (ii)) may be from 2:1 to 1:2, from 3:2 to 2:3, or from 4:3 to 3:4.

Component (iii) may be one or more zinc dihydrocarbyl dithiophosphate compounds. Such compounds are known in the art and often referred to as ZDDP. They may be prepared in accordance with known techniques, such as by first forming a dihydrocarbyl dithiophosphoric acid (DDPA), usually by reaction of one or more alcohols or a phenol with $P_2S_5$, and then neutralizing the formed DDPA with a zinc compound. For example, a dithiophosphoric acid may be made by reacting mixtures of primary and secondary alcohols. Alternatively, dithiophosphoric acids can be prepared where the hydrocarbyl groups are entirely secondary in character or the hydrocarbyl groups are entirely primary in character. To make the zinc salt, any basic or neutral zinc compound may be used, but oxides, hydroxides, and carbonates are typically employed. Commercial additives may frequently contain an excess of zinc, due to the use of an excess of the basic zinc compound in the neutralization reaction.

Advantageous zinc dihydrocarbyl dithiophosphates may comprise or be oil-soluble salts of dihydrocarbyl dithiophosphoric acids, such as represented by the following formula:

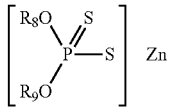

wherein $R_8$ and $R_9$ may be the same or different hydrocarbyl radicals containing from 1 to 18 (e.g., from 2 to 12 or from 2 to 8) carbon atoms, examples of which hydrocarbyl radicals may include one or more of alkyl, alkenyl, aryl, arylalkyl, alkaryl, and cycloaliphatic radicals. Exemplary hydrocarbyl radicals may comprise or be, but are not necessarily limited to, ethyl, n-propyl, i-propyl, n-butyl, i-butyl, sec-butyl, amyl, n-hexyl, i-hexyl, n-octyl, decyl, dodecyl, octadecyl, 2-ethylhexyl, phenyl, benzyl, butylphenyl, cyclohexyl, methylcyclopentyl, propenyl, butenyl, and combinations thereof. In order to obtain and/or maintain oil solubility, the total number of carbon atoms on each dihydrocarbyl dithiophosphoric acid ligand (i.e., a single $R_8$ and $R_9$ pair) may generally be at least about 5. In particular, the zinc dihydrocarbyl dithiophosphate can therefore comprise or be a zinc dialkyl dithiophosphate.

In particular, Component (iii) may be present in the transmission fluid composition in an amount from 0.4 to 5.0% by mass, based on the total mass of the composition, from 0.6 to 3.5% by mass, from 1.0 to 3.0% by mass, or from 1.2 to 2.5% by mass. Additionally or alternatively, in particular, Component (iii) may individually provide the transmission fluid composition with from 300 to 4000 parts per million by mass of phosphorous, based on the total mass of the composition, from 500 to 2500 ppm, from 750 to 2000 ppm, or from 800 to 1600 ppm. Phosphorus content is measured in accordance with ASTM D5185. Further additionally or alternatively, in particular, Component (iii) may provide the transmission fluid composition with from 400 to 4500 parts per million by mass of zinc, based on the total mass of the composition, from 500 to 3000 ppm, from 800 to 2600 ppm, or from 1000 to 2200 ppm. Zinc content can be measured in accordance with ASTM D5185.

Component (iv) may be one or more oil-soluble or oil-dispersible molybdenum-containing compounds, such as an oil-soluble or oil-dispersible organo-molybdenum compound. Non-limiting examples of such oil-soluble or oil-dispersible organo-molybdenum compound may include, but are not necessarily limited to, molybdenum dithiocarbamates, molybdenum dithiophosphates, molybdenum dithiophosphinates, molybdenum xanthates, molybdenum thioxanthates, molybdenum sulfides, and the like, and mixtures thereof, in particular one or more of molybdenum dialkyldithiocarbamates, molybdenum dialkyldithiophosphates, molybdenum alkyl xanthates, and molybdenum alkylthioxanthates. Representative molybdenum alkyl xanthate and molybdenum alkylthioxanthate compounds may be expressed using the formulae of $Mo(R_{15}OCS_2)_4$ and $Mo(R_{15}SCS_2)_4$, respectively, wherein each $R_{15}$ may independently be an organo group selected from the group consisting of alkyl, aryl, aralkyl, and alkoxyalkyl, generally having from 1 to 30 carbon atoms or from 2 to 12 carbon atoms, in particular each being an alkyl group having from 2 to 12 carbon atoms.

In certain embodiments, the oil-soluble or oil-dispersible organo-molybdenum compound may comprise a molybdenum dithiocarbamate, such as a molybdenum dialkyldithiocarbamate, and/or may be substantially free from molybdenum dithiosphosphates, in particular from molybdenum dialkyldithiophosphates. In certain other embodiments, any oil-soluble or oil-dispersible molybdenum compounds may consist of a molybdenum dithiocarbamate, such as a molybdenum dialkyldithiocarbamate, and/or a molybdenum dithiophosphate, such as a molybdenum dialkyldithiophosphate, as the sole source(s) of molybdenum atoms in the composition. In either set of embodiments, the oil-soluble or oil-dispersible molybdenum compound may consist essentially of a molybdenum dithiocarbamate, such as a molybdenum dialkyldithiocarbamate, as the sole source of molybdenum atoms in the transmission fluid.

The molybdenum compound may be mono-, di-, tri-, or tetra-nuclear, in particular comprising or being di-nuclear and/or tri-nuclear molybdenum compounds.

Suitable dinuclear or dimeric molybdenum dialkyldithiocarbamates, for example, can be represented by the following formula:

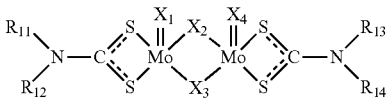

where $R_{11}$ through $R_{14}$ may each independently represent a straight chain, branched chain, or aromatic hydrocarbyl group having 1 to 24 carbon atoms, and where $X_1$ through $X_4$ may each independently represent an oxygen atom or a sulfur atom. The four hydrocarbyl groups, $R_{11}$ through $R_{14}$, may be identical to, or different from, each other.

Suitable tri-nuclear organo-molybdenum compounds may include those having the formula: $Mo_3S_kL_nQ_z$, and mixtures thereof. In such tri-nuclear formula, the three molybdenum atoms may be linked to multiple sulfur atoms (S), with k varying from 4 through 7. Additionally, each L may be an independently selected organic ligand having a sufficient number of carbon atoms to render the compound oil-soluble or oil-dispersible, with n being from 1 to 4. Further, when z is non-zero, Q may be selected from the group of neutral electron donating compounds such as water, amines, alcohols, phosphines, and/or ethers, with z ranging from 0 to 5 and including non-stoichiometric (non-integer) values.

In such tri-nuclear formula, at least 21 total carbon atoms (e.g., at least 25, at least 30, or at least 35) may typically be present among the combination of all ligands ($L_n$). Importantly, however, the organic groups of the ligands may advantageously collectively exhibit a sufficient number of carbon atoms to render the compound soluble or dispersible in the oil. For example, the number of carbon atoms within each ligand L may generally range from 1 to 100, e.g., from 1 to 30 or from 4 to 20.

Tri-nuclear molybdenum compounds having the formula $Mo_3S_kL_nQ_z$ may advantageously exhibit cationic cores surrounded by anionic ligands, such as represented by one or both of the following structures:

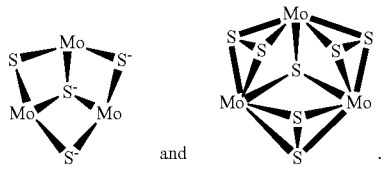

Such cationic cores may each have a net charge of +4 (e.g., due to the oxidation state of the Mo atoms each being +4). Consequently, in order to solubilize these cores, the total charge among all the ligands should correspond, in this case being −4. Four mono-anionic ligands may offer an advantageous core neutralization. Without wishing to be bound by any theory, it is believed that two or more tri-nuclear cores may be bound or interconnected by means of one or more ligands, and the ligands may be multidentate. This includes the case of a multidentate ligand having multiple connections to a single core. Oxygen and/or selenium may be substituted for some portion of the sulfur atoms in either of the cores.

As ligands for the tri-nuclear cores described above, non-limiting examples may include, but am not necessarily limited to, dithiophosphates such as dialkyldithiophosphate, xanthates such as alkylxanthate and/or alkylthioxanthate, dithiocarbamates such as dialkyldithiocarbamate, and combinations thereof, in particular each comprising or being dialkyldithiocarbamate. Additionally or alternatively, the ligands for the tri-nuclear molybdenum-containing cores may independently be one or more of the following:

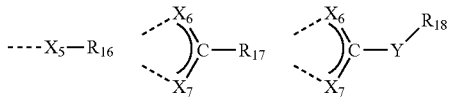

-continued

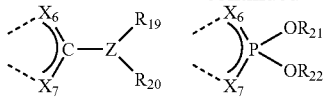

where $X_5$, $X_6$, $X_7$, and Y are each independently oxygen or sulfur, where Z is nitrogen or boron, and wherein $R_{16}$, $R_{17}$, $R_{18}$, $R_{19}$, $R_{20}$, $R_{21}$, and $R_{22}$ are each independently hydrogen or an organic (carbon-containing) moiety, such as a hydrocarbyl group, that may be the same or different from each other, in particular the same. Exemplary organic moieties may include or be alkyl (e.g., in which the carbon atom attached to the remainder of the ligand is primary or secondary), aryl, substituted aryl, alkaryl, substituted alkaryl, aralkyl, substituted aralkyl, an ether, a thioether, or a combination or reaction product thereof, in particular alkyl.

Oil-soluble or oil-dispersible tri-nuclear molybdenum compounds can be prepared by reacting in the appropriate liquid(s) solvent(s) a molybdenum source such as $(NH_4)_2Mo_3S_{13}.n(H_2O)$, where n varies from 0 to 2 including non-stoichiometric (non-integer) values, with a suitable ligand source, such as a tetralkylthiuram disulfide. Other oil-soluble or dispersible tri-nuclear molybdenum compounds can be formed during a reaction in the appropriate solvent(s) of a molybdenum source such as of $(NH_4)_2Mo_3S_{13}.n(H_2O)$, a ligand source, such as tetralkylthiuram disulfide, a dialkyldithiocarbamate, or a dialkyldithiophosphate, and a sulfur abstracting agent, such as cyanide ions, sulfite ions, or substituted phosphines. Alternatively, a tri-nuclear molybdenum-sulfur halide salt such as $[M']_2[Mo_3S_7A_6]$, where M' is a counter ion and A is a halogen such as Cl, Br, or I, may be reacted with a ligand source such as a dialkyldithiocarbamate or a dialkyldithiophosphate in an appropriate liquid/solvent (system) to form an oil-soluble or oil-dispersible trinuclear molybdenum compound. The appropriate liquid/solvent (system) may be, for example, aqueous or organic.

Other molybdenum precursors may include acidic molybdenum compounds. Such compounds may react with a basic nitrogen compound, as measured by ASTM D-664 or D-2896 titration procedure, and may typically be hexavalent. Examples may include, but are not necessarily limited to, molybdic acid, ammonium molybdate, sodium molybdate, potassium molybdate, and other alkaline metal molybdates and other molybdenum salts, e.g., hydrogen sodium molybdate, $MoOCl_4$, $MoO_2Br_2$, $Mo_2O_3Cl_6$, molybdenum trioxide, or similar acidic molybdenum compounds, or combinations thereof. Thus, additionally or alternatively, the compositions of the present disclosure can be provided with molybdenum by molybdenum/sulfur complexes of basic nitrogen compounds as described, for example, in U.S. Pat. Nos. 4,263,152, 4,285,822, 4,283,295, 4,272,387, 4,265,773, 4,261,843, 4,259,195, and 4,259,194, and/or in PCT Publication No. WO 94/06897.

In particular, Component (iv) may be present in the transmission fluid composition in an amount from 0.1 to 2.0% by mass, based on the total mass of the composition, from 0.1 to 1.5% by mass, from 0.2 to 1.2% by mass, or from 0.2% to 0.8% by mass. Additionally or alternatively, in particular, Component (iv) may provide the transmission fluid composition with from 50 to 1000 parts per million by mass of molybdenum, based on the total mass of the composition, from 50 to 800 ppm, from 100 to 650 ppm, or from 100 to 500 ppm. Molybdenum content can be measured in accordance with ASTM D5185.

The amount of lubricating oil basestock in transmission fluid compositions according to the present disclosure can typically be a major amount (i.e., more than 50%, based on the weight of the composition), with the additive package collectively, and each of the components of the additive package individually, typically constituting a minor amount (i.e., less than 50%, based on the weight of the composition). For example, the transmission fluid composition may comprise from above 50% to 99.5%, from above 50% to 99%, from above 50% to 98.5%, from above 50% to 98%, from above 50% to 97.5%, from above 50% to 97%, from above 50% to 96.5%, from above 50% to 96%, from above 50% to 95.5%, from above 50% to 95%, from 60% to 99.5%, from 60% to 99%, from 60% to 98.5%, from 60% to 98%, from 60% to 97.5%, from 60% to 97%, from 60% to 9.5%, from 60% to %%, from 60% to 95.5%, from 60% to 95%, from 70% to 99.5%, from 70% to 99%, from 70% to 98.5%, from 70% to 98%, from 70% to 97.5%, from 70% to 97%, from 70% to 96.5%, from 70% to 96%, from 70% to 95.5%, from 70% to 95%, from 75% to 99.5%, from 75% to 99%, from 75% to 98.5%, from 75% to 98%, from 75% to 97.5%, from 75% to 97%, from 75% to 96.5%, from 75% to 96%, from 75% to 95.5%, from 75% to 95%, from 80% to 99.5%, from 80% to 99%, from 80% to 98.5%, from 80% to 98%, from 80% to 97.5%, from 80% to 97%, from 80% to 96.5%, from 80% to 96%, from 80% to 95.5%, or from 80% to 95%, of lubricating oil basestock, based on the weight of the composition, in particular from 60% to 99%, from 70 to 98%, from 75 to 97%, or from 80 to 96.5%, based on the weight of the composition. Additionally or alternatively, the transmission fluid composition may comprise from 0.5% to below 50%, from 0.5% to 39%, from 0.5% to 34%, from 0.5% to 29%, from 0.5% to 24%, from 0.5% to 19.5%, from 0.5% to 14.5%, from 0.5% to 11.5%, from 0.5% to 9.5%, from 0.5% to 7.5%, from 0.5% to 6.5%, from 0.5% to 5.5%, from 0.5% to 5.0%, from 0.5% to 4.5%, from 0.5% to 4.0%, from 0.5% to 3.5%, from 0.5% to 3.0%, from 0.5% to 2.5%, from 0.5% to 2.0%, from 0.5% to 1.5%, from 1.0% to below 50%, from 1.0% to 39%, from 1.0% to 34%, from 1.0% to 29%, from 1.0% to 24%, from 1.0% to 19.5%, from 1.0% to 14.5%, from 1.0% to 11.5%, from 1.0% to 9.5%, from 1.0% to 7.5%, from 1.0% to 6.5%, from 1.0% to 5.5%, from 1.0% to 5.0%, from 1.0% to 4.5%, from 1.0% to 4.0%, from 1.0% to 3.5%, from 1.0% to 3.0%, from 1.0% to 2.5%, from 1.0% to 2.0%, from 1.5% to below 50%, from 1.5% to 39%, from 1.5% to 34%, from 1.5% to 29%, from 1.5% to 24%, from 1.5% to 19.5%, from 1.5% to 14.5%, from 1.5% to 1.5%, from 1.5% to 9.5%, from 1.5% to 7.5%, from 1.5% to 6.5%, from 1.5% to 5.5%, from 1.5% to 5.0%, from 1.5% to 4.5%, from 1.5% to 4.0%, from 1.5% to 3.5%, from 1.5% to 3.0%, from 1.5% to 2.5%, from 1.9% to below 50%, from 1.9% to 39%, from 1.9% to 34%, from 1.9% to 29%, from 1.9% to 24%, from 1.9% to 19.5%, from 1.9% to 14.5%, from 1.9% to 11.5%, from 1.9% to 9.5%, from 1.9% to 7.5%, from 1.9% to 6.5%, from 1.9% to 5.5%, from 1.9% to 5.0%, from 1.9% to 4.5%, from 1.9% to 4.0%, from 1.9% to 3.5%, from 1.9% to 3.0%, from 2.4% to below 50%, from 2.4% to 39%, from 2.4% to 34%, from 2.4% to 29%, from 2.4% to 24%, from 2.4% to 19.5%, from 2.4% to 14.5%, from 2.4% to 11.5%, from 2.4% to 9.5%, from 2.4% to 7.5%, from 2.4% to 6.5%, from 2.4% to 5.5%, from 2.4% to 5.0%, from 2.4% to 4.5%, from 2.4% to 4.0%, from 2.4% to 3.5%, from 2.9% to below 50%, from 2.9% to 39%, from 2.9% to 34%, from 2.9% to 29%, from 2.9% to 24%, from 2.9% to 19.5%, from 2.9% to 14.5%, from 2.9% to 11.5%, from 2.9% to 9.5%, from 2.9% to 7.5%, from 2.9% to 6.5%, from 2.9% to 5.5%, from 2.9% to 5.0%, from 2.9% to 4.5%, or from 2.9% to 4.0%, of additive package components, based on the weight of the composition, in particular from 1.0% to 39%, from 1.5% to 34%, from 1.9% to 29%, or from 2.4 to 24%, based on the weight of the composition.

The lubricating oil basestock may be any suitable lubricating oil basestock known in the art. Both natural and synthetic lubricating oil basestocks may be suitable. Natural lubricating oils may include animal oils, vegetable oils (e.g., castor oil and lard oil), petroleum oils, mineral oils, oils derived from coal or shale, and combinations thereof. One particular natural lubricating oil includes or is mineral oil.

Suitable mineral oils may include all common mineral oil basestocks, including oils that are naphthenic or paraffinic in chemical structure. Suitable oils may be refined by conventional methodology using acid, alkali, and clay, or other agents such as aluminum chloride, or they may be extracted oils produced, for example, by solvent extraction with solvents such as phenol, sulfur dioxide, furfural, dichlorodiethyl ether, etc., or combinations thereof. They may be hydrotreated or hydrofined, dewaxed by chilling or catalytic dewaxing processes, hydrocracked, or some combination thereof. Suitable mineral oils may be produced from natural crude sources or may be composed of isomerized wax materials, or residues of other refining processes.

Synthetic lubricating oils may include hydrocarbon oils and halo-substituted hydrocarbon oils such as oligomerized, polymerized, and interpolymerized olefins (e.g., polybutylenes, polypropylenes, propylene, isobutylene copolymers, chlorinated polylactenes, poly(1-hexenes), poly(1-octenes), poly-(1-decenes), etc., and mixtures thereof); alkylbenzenes (e.g., dodecyl-benzenes, tetradecylbenzenes, dinonyl-benzenes, di(2-ethylhexyl)benzene, etc.); polyphenyls (e.g., biphenyls, terphenyls, alkylated polyphenyls, etc.); alkylated diphenyl ethers, alkylated diphenyl sulfides, as well as their derivatives, analogs, and homologs thereof, and the like; and combinations and/or reaction products thereof.

In some embodiments, oils from this class of synthetic oils may comprise or be polyalphaolefins (PAO), including hydrogenated oligomers of an alpha-olefin, particularly oligomers of 1-decene, such as those produced by free radical processes, Ziegler catalysis, or cationic catalysis. They may, for example, be oligomers of branched or straight chain alpha-olefins having from 2 to 16 carbon atoms, specific non-limiting examples including polypropenes, polyisobutenes, poly-1-butenes, poly-1-hexenes, poly-1-octenes, poly-1-decene, poly-1-dodecene, and mixtures and/or interpolymers/copolymers thereof.

Synthetic lubricating oils may additionally or alternatively include alkylene oxide polymers, interpolymers, copolymers, and derivatives thereof, in which any (most) terminal hydroxyl groups have been modified by esterification, etherification, etc. This class of synthetic oils may be exemplified by: polyoxyalkylene polymers prepared by polymerization of ethylene oxide or propylene oxide; the alkyl and aryl ethers of these polyoxyalkylene polymers (e.g., methyl-polyisopropylene glycol ether having an average Mn of ~1000 Daltons, diphenyl ether of polypropylene glycol having an average Mn from about 1000 to about 1500 Daltons); and mono- and poly-carboxylic esters thereof (e.g., acetic acid ester(s), mixed $C_3$-$C_8$ fatty acid esters, $C_{12}$ oxo acid diester(s) of tetraethylene glycol, or the like, or combinations thereof).

Another suitable class of synthetic lubricating oils may comprise the esters of dicarboxylic acids (e.g., phthalic acid, succinic acid, alkyl succinic acids and alkenyl succinic acids, maleic acid, azelaic acid, suberic acid, sebasic acid, fumaric acid, adipic acid, linoleic acid dimer, malonic acid, alkylmalonic acids, alkenyl malonic acids, etc.) with a variety of alcohols (e.g., butyl alcohol, hexyl alcohol, dodecyl alcohol, 2-ethylhexyl alcohol, ethylene glycol, diethylene glycol monoethers, propylene glycol, etc.). Specific examples of these esters include dibutyl adipate, di(2-ethylhexyl) sebacate, di-n-hexyl fumarate, dioctyl sebacate, diisooctyl azelate, diisodecyl azelate, dioctyl phthalate, didecyl phthalate, dieicosyl sebacate, the 2-ethylhexyl diester of linoleic acid dimer, a complex ester formed by reacting one mole of sebacic acid with two moles of tetraethylene glycol and two moles of 2-ethyl-hexanoic acid, and the like, and combinations thereof. A preferred type of oil from this class of synthetic oils may include adipates of $C_4$ to $C_{12}$ alcohols.

Esters useful as synthetic lubricating oils may additionally or alternatively include those made from $C_5$-$C_{12}$ monocarboxylic acids, polyols, and/or polyol ethers, e.g., such as neopentyl glycol, trimethylolpropane pentaerythritol, dipentaerythritol, tripentaerythritol, and the like, as well as combinations thereof.

The lubricating oils may be derived from unrefined oils, refined oils, re-refined oils, or mixtures thereof. Unrefined oils are obtained directly from a natural source or synthetic source (e.g., coal, shale, or tar sands bitumen) without further purification or treatment. Examples of unrefined oils may include a shale oil obtained directly from a retorting operation, a petroleum oil obtained directly from distillation, or an ester oil obtained directly from an esterification process, each or a combination of which may then be used without further treatment. Refined oils are similar to the unrefined oils, except that refined oils have typically been treated in one or more purification steps to change chemical structure and/or to improve one or more properties. Suitable purification techniques may include distillation, hydrotreating, dewaxing, solvent extraction, acid or base extraction, filtration, and percolation, all of which are known to those skilled in the art. Re-refined oils may be obtained by treating used and/or refined oils in processes similar to those used to obtain refined oils in the first place. Such re-refined oils may be known as reclaimed or reprocessed oils and may often additionally be processed by techniques for removal of spent additives and oil breakdown products.

Another additional or alternative class of suitable lubricating oils may include those basestocks produced from oligomerization of natural gas feed stocks or isomerization of waxes. These basestocks can be referred to in any number of ways but commonly they are known as Gas-to-Liquid (GTL) or Fischer-Tropsch basestocks.

The lubricating oil basestock according to the present disclosure may be a blend of one or more of the oils/basestocks described herein, whether of a similar or different type, and a blend of natural and synthetic lubricating oils (I.e., partially synthetic) is expressly contemplated for this disclosure.

Lubricating oils can be classified as set out in the American Petroleum Institute (API) publication "Engine Oil Licensing and Certification System", Industry Services Department, Fourteenth Edition, December 1996, Addendum 1, December 1998, in which oils are categorized as follows:

a) Group I basestocks contain less than 90 percent saturates and/or greater than 0.03 percent sulfur and have a viscosity index greater than or equal to 80 and less than 120;

b) Group II basestocks contain greater than or equal to 90 percent saturates and less than or equal to 0.03 percent sulfur and have a viscosity index greater than or equal to 80 and less than 120;

c) Group III basestocks contain greater than or equal to 90 percent saturates and less than or equal to 0.03 percent sulfur and have a viscosity index greater than or equal to 120;

d) Group IV basestocks are polyalphaolefins (PAO); and, e) Group V basestocks include all other basestock oils not included in Groups I, II, III, or IV.

In an embodiment of the present disclosure, the lubricating oil may comprise or be a mineral oil or a mixture of mineral oils, in particular mineral oils of Group II and/or Group III (of the API classification). Additionally or alternatively, the lubricating oil may comprise or be a synthetic oil such as a polyalphaolefin (Group IV) and/or an oil of Group V.

Advantageously, the transmission fluid composition may exhibit a kinematic viscosity at 100° C. (KV100), as measured by ASTM D445, of up to 20 cSt (e.g., up to 15 cSt, up to 12 cSt, up to 10 cSt, up to 8 cSt, up to 7 cSt, up to 6.5 cSt, up to 6.0 cSt, up to 5.5 cSt, up to 5.0 cSt, up to 4.5 cSt, up to 4.0 cSt, up to 3.5 cSt, up to 3.0 cSt, up to 2.5 cSt, up to 2.0, from 1 cSt to 20 cSt, from 1 cSt to 15 cSt, from 1 cSt to 12 cSt, from 1 cSt to 10 cSt, from 1 cSt to 8 cSt, from 1 cSt to 7 cSt, from 1 cSt to 6.5 cSt, from 1 cSt to 6.0 cSt, from 1 cSt to 5.5 cSt, from 1 cSt to 5.0 cSt, from cSt to 4.5 cSt, from 1 cSt to 4.0 cSt, from 1 cSt to 3.5 cSt, from 1 cSt to 3.0 cSt, from 1 cSt to 2.5 cSt, from 1 cSt to 2.0 cSt, from 2 cSt to 20 cSt, from 2 cSt to 15 cSt, from 2 cSt to 12 cSt, from 2 cSt to 10 cSt, from 2 cSt to 8 cSt, from 2 cSt to 7 cSt, from 2 cSt to 6.5 cSt, from 2 cSt to 6.0 cSt, from 2 cSt to 5.5 cSt, from 2 cSt to 5.0 cSt, from 2 cSt to 4.5 cSt, from 2 cSt to 4.0 cSt, from 2 cSt to 3.5 cSt, from 2 cSt to 3.0 cSt, from 2 cSt to 2.5 cSt, from 2.5 cSt to 20 cSt, from 2.5 cSt to 15 cSt, from 2.5 cSt to 12 cSt, from 2.5 cSt to 10 cSt, from 2.5 cSt to 8 cSt, from 2.5 cSt to 7 cSt, from 2.5 cSt to 6.5 cSt, from 2.5 cSt to 6.0 cSt, from 2.5 cSt to 5.5 cSt, from 2.5 cSt to 5.0 cSt, from 2.5 cSt to 4.5 cSt, from 2.5 cSt to 4.0 cSt, from 2.5 cSt to 3.5 cSt, from 2.5 cSt to 3.0 cSt, from 3 cSt to 20 cSt, from 3 cSt to 15 cSt, from 3 cSt to 12 cSt, from 3 cSt to 10 cSt, from 3 cSt to 8 cSt, from 3 cSt to 7 cSt, from 3 cSt to 6.5 cSt, from 3 cSt to 6.0 cSt, from 3 cSt to 5.5 cSt, from 3 cSt to 5.0 cSt, from 3 cSt to 4.5 cSt, from 3 cSt to 4.0 cSt, from 3 cSt to 3.5 cSt, from 3.5 cSt to 20 cSt, from 3.5 cSt to 15 cSt, from 3.5 cSt to 12 cSt, from 3.5 cSt to 10 cSt, from 3.5 cSt to 8 cSt, from 3.5 cSt to 7 cSt, from 3.5 cSt to 6.5 cSt, from 3.5 cSt to 6.0 cSt, from 3.5 cSt to 5.5 cSt, from 3.5 cSt to 5.0 cSt, from 3.5 cSt to 4.5 cSt, from 3.5 cSt to 4.0 cSt, from 4 cSt to 20 cSt, from 4 cSt to 15 cSt, from 4 cSt to 12 cSt, from 4 cSt to 10 cSt, from 4 cSt to 8 cSt, from 4 cSt to 7 cSt, from 4 cSt to 6.5 cSt, from 4 cSt to 6.0 cSt, from 4 cSt to 5.5 cSt, from 4 cSt to 5.0 cSt, or from 4 cSt to 4.5 cSt), in particular from 1 cSt to 20 cSt, such as from 2 cSt to 10 cSt, from 2 cSt to 8 cSt, or from 2.5 cSt to 6.5 cSt.

The required components (i), (ii), (iii), and (iv) may be added separately to the lubricating oil to form the transmission fluid composition or, more conveniently, may be added to the oil as an additive package containing the required compounds dissolved or dispersed in a carrier fluid. Further alternatively, two or more of the components may be added together as an additive package, while one or more other components may be added separately to the lubricating oil and/or to the admixture for forming the transmission fluid composition. Such an additive package may optionally further contain, or the transmission fluid composition may contain separate from the additive package, one or more co-additives as defined hereinbelow.

Co-Additives

Co-additives commonly found in transmission fluids may optionally be included in the transmission fluid composition of the present disclosure. Suitable co-additives will be known to those skilled in the art. Some examples are described herein.

Ashless Dispersants

In particular, the additive package and/or the transmission fluid composition may further comprise one or more ashless dispersants.

Examples of ashless dispersants may include polyisobutenyl succinimides, polyisobutenyl succinamides, mixed ester/amides of polyisobutenyl-substituted succinic acid, hydroxyesters of polyisobutenyl-substituted succinic acid, and Mannich condensation products of hydrocarbyl-substituted phenols, formaldehyde, and polyamines, as well as reaction products and mixtures thereof.

Basic nitrogen-containing ashless dispersants are well-known lubricating oil additives and methods for their preparation are extensively described in the patent literature. Exemplary dispersants may include the polyisobutenyl succinimides and succinamides in which the polyisobutenyl-substituent is a long-chain of greater than 36 carbons, e.g., greater than 40 carbon atoms. These materials can be readily made by reacting a polyisobutenyl-substituted dicarboxylic acid material with a molecule containing amine functionality. Examples of suitable amines may include polyamines such as polyalkylene polyamines, hydroxy-substituted polyamines, polyoxyalkylene polyamines, and combinations thereof. The amine functionality may be provided by polyalkylene polyamines such as tetraethylene pentamine and pentaethylene hexamine.

Mixtures where the average number of nitrogen atoms per polyamine molecule is greater than 7 are also available. These are commonly called heavy polyamines or H-PAMs and may be commercially available under trade names such as HPA™ and HPA-X™ from DowChemical, E-100™ from Huntsman Chemical, et al. Examples of hydroxy-substituted polyamines may include N-hydroxyalkyl-alkylene polyamines such as N-(2-hydroxyethyl)ethylene diamine, N-(2-hydroxyethyl)piperazine, and/or N-hydroxyalkylated alkylene diamines of the type described, for example, in U.S. Pat. No. 4,873,009. Examples of polyoxyalkylene polyamines may include polyoxyethylene and polyoxypropylene diamines and triamines having an average Mn from about 200 to about 2500 Daltons. Products of this type may be commercially available under the tradename Jeffamine™.

As is known in the art, reaction of the amine with the polyisobutenyl-substituted dicarboxylic acid material (suitably an alkenyl succinic anhydride or maleic anhydride) can be conveniently achieved by heating the reactants together, e.g., in an oil solution. Reaction temperatures of ~100° C. to ~250° C. and reaction times from ~1 to ~10 hours may be typical. Reaction ratios can vary considerably, but generally from about 0.1 to about 1.0 equivalents of dicarboxylic acid unit content may be used per reactive equivalent of the amine-containing reactant.

In particular, the ashless dispersant may include a polyisobutenyl succinimide formed from polyisobutenyl succinic anhydride and a polyalkylene polyamine such as tetraethylene pentamine or H-PAM. The polyisobutenyl group may be derived from polyisobutene and may exhibit a number average molecular weight (Mn) from about 750 to about 5000 Daltons, e.g., from about 900 to about 2500 Daltons. As is known in the art, dispersants may be post treated (e.g., with a borating/boronating agent and/or with an inorganic acid of phosphorus). Suitable examples may be found, for instance, in U.S. Pat. Nos. 3,254,025, 3,502,677, and 4,857,214.

When used, an ashless dispersant may be present in an amount of from 0.01 to 10% by mass, based on the mass of the transmission fluid composition, e.g., from 0.1 to 5% by mass. A mixture of more than one ashless dispersant may be included in the transmission fluid composition in which case, the amounts given herein refer to the total amount of the mixture of dispersants used.

Detergents

The transmission fluid composition may further comprise a detergent, such as a calcium-containing detergent. These compounds are sufficiently oil-soluble or dispersible such as to remain dissolved or dispersed in an oil in order to be transported by the oil to their intended site of action. Calcium-containing detergents are known in the art and include neutral and overbased calcium salts with acidic substances such as salicylic acids, sulfonic acids, carboxylic acids, alkyl phenols, sulfurized alkyl phenols and mixtures of these substances.

Neutral calcium-containing detergents are those detergents that contain stoichiometrically equivalent amounts of calcium in relation to the amount of (Lewis) acidic moieties present in the detergent. Thus, in general, neutral detergents can typically have a relatively low basicity, when compared to their overbased counterparts.

The term "overbased," for example in connection with calcium detergents, is used to designate the fact that the calcium component is present in stoichiometrically larger amounts than the corresponding (Lewis) acid component. The commonly employed methods for preparing the overbased salts involve heating a mineral oil solution of an acid with a stoichiometric excess of a neutralizing agent at an appropriate temperature (in this case, a calcium neutralizing agent, such as an oxide, hydroxide, carbonate, bicarbonate, sulfide, or combination thereof, at a temperature of about 50° C.) and filtering the resultant product. The use of a "promoter" in the neutralization step to aid the incorporation of a large excess of salt/base (in this case, calcium) likewise is known. Examples of compounds useful as a promoter may include, but are not necessarily limited to, phenolic substances such as phenol, naphthol, alkyl phenol, thiophenol, sulfurized alkylphenol, and condensation products of formaldehyde with a phenolic substance; alcohols such as methanol, 2-propanol, octanol, Cellosolve™ alcohol, Carbitol™ alcohol, ethylene glycol, stearyl alcohol, and cyclohexyl alcohol; amines such as aniline, phenylene diamine, phenothiazine, phenyl-beta-naphthylamine, and dodecylamine; and combinations thereof. A particularly effective method for preparing the basic salts comprises mixing an acidic substance with an excess of calcium neutralizing agent and at least one alcohol promoter, and carbonating the mixture at an elevated temperature, such as from 60 to 200° C.

Examples of calcium-containing detergents useful in the transmission fluid compositions of the present disclosure may include, but are not necessarily limited to, neutral and/or overbased salts of such substances as calcium phenates; sulfurized calcium phenates (e.g., wherein each aromatic group has one or more aliphatic groups to impart hydrocarbon solubility); calcium sulfonates (e.g., wherein each sulfonic acid moiety is attached to an aromatic nucleus, which in turn usually contains one or more aliphatic substituents to impart hydrocarbon solubility); calcium salicylates (e.g., wherein the aromatic moiety is usually substituted by one or more aliphatic substituents to impart hydrocarbon solubility); calcium salts of hydrolyzed phosphosulfurized olefins (e.g., having 10 to 2000 carbon atoms) and/or of hydrolyzed phosphosulfurized alcohols and/or aliphatic-substituted phenolic compounds (e.g., having 10 to 2000 carbon atoms); calcium salts of aliphatic carboxylic acids and/or aliphatic substituted cycloaliphatic carboxylic acids; and combinations and/o reaction products thereof; as well as many other similar calcium salts of oil-soluble organic acids. Mixtures of neutral and/or overbased salts of two or more different acids can be used, if desired (e.g., one or more overbased calcium phenates with one or more overbased calcium sulfonates).

Methods for the production of oil-soluble neutral and overbased calcium detergents are well known to those skilled in the art and are extensively reported in the patent literature. Calcium-containing detergents may optionally be post-treated, e.g., borated. Methods for preparing borated detergents are well known to those skilled in the art, and are extensively reported in the patent literature.

When present, a calcium-containing detergent may advantageously comprise, consist essentially of, or consist of a neutral or overbased calcium sulfonate detergent and/or a neutral or overbased calcium salicylate detergent. When present, the calcium-containing detergent may provide the transmission fluid composition with, in particular, from 300 to 5000 parts per million by mass (ppm) of calcium, based on the mass of the composition, from 500 to 4500 ppm, from 800 to 4500 ppm, or from 1000 to 4000 ppm.

Anti-Oxidant

Antioxidants are sometimes referred to as oxidation inhibitors and may increase the resistance (or decrease the susceptibility) of the transmission fluid composition to oxidation. They may work by combining with and modifying oxidative agents, such as peroxides and other free radical-forming compounds, to render them harmless, e.g., by decomposing them or by rendering inert a catalyst or facilitator of oxidation. Oxidative deterioration can be evidenced by sludge in the fluid with increased use, by varnish-like deposits on metal surfaces, and sometimes by viscosity increase.

Examples of suitable antioxidants may include, but are not limited to, copper-containing antioxidants, sulfur-containing antioxidants, aromatic amine-containing and/or amide-containing antioxidants, hindered phenolic antioxidants, dithiophosphates and derivatives, and the like, as well as combinations and certain reaction products thereof. Some anti-oxidants may be ashless (i.e., may contain few, if any, metal atoms other than trace or contaminants). In preferred embodiments, one or more antioxidant is present in a transmission fluid composition according to the present disclosure. In particular, a transmission fluid composition of the present disclosure may comprise a combination of an aromatic amine antioxidant and a hindered phenolic antioxidant.

Corrosion Inhibitors

Corrosion inhibitors may be used to reduce the corrosion of metals and are often alternatively referred to as metal deactivators or metal passivators. Some corrosion inhibitors may alternatively be characterized as antioxidants.

Suitable corrosion inhibitors may include nitrogen and/or sulfur containing heterocyclic compounds such as triazoles (e.g., benzotriazoles), substituted thiadiazoles, imidazoles, thiazoles, tetrazoles, hydroxyquinolines, oxazolines, imidazolines, thiophenes, indoles, indazoles, quinolines, benzoxazines, dithiols, oxazoles, oxatriazoles, pyridines, piperazines, triazines and derivatives of any one or more thereof. A particular corrosion inhibitor is a benzotriazole represented by the structure:

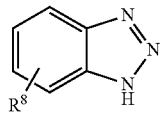

wherein $R^8$ is absent or is a $C_1$ to $C_{20}$ hydrocarbyl or substituted hydrocarbyl group which may be linear or branched, saturated or unsaturated. It may contain ring structures that are alkyl or aromatic in nature and/or contain heteroatoms such as N, O, or S. Examples of suitable compounds may include benzotriazole, alkyl-substituted benzotriazoles (e.g., tolyltriazole, ethylbenzotriazole, hexylbenzotriazole, octylbenzotriazole, etc.), aryl substituted benzotriazole, alkylaryl- or arylalkyl-substituted benzotriazoles, and the like, as well as combinations thereof. For instance, the triazole may comprise or be a benzotriazole and/or an alkylbenzotriazole in which the alkyl group contains from 1 to about 20 carbon atoms or from 1 to about 8 carbon atoms. A preferred corrosion inhibitor may comprise or be benzotriazole and/or tolyltriazole.

Additionally or alternatively, the corrosion inhibitor may include a substituted thiadiazoles represented by the structure:

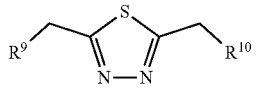

wherein $R^9$ and $R^{10}$ are independently hydrogen or a hydrocarbon group, which group may be aliphatic or aromatic, including cyclic, alicyclic, aralkyl, aryl and alkaryl. These substituted thiadiazoles are derived from the 2,5-dimercapto-1,3,4-thiadiazole (DMTD) molecule. Many derivatives of DMTD have been described in the art, and any such compounds can be included in the transmission fluid used in the present disclosure. For example, U.S. Pat. Nos. 2,719,125, 2,719,126, and 3,087,937 describe the preparation of various 2, 5-bis-(hydrocarbon dithio)-1,3,4-thiadiazoles.

Further additionally or alternatively, the corrosion inhibitor may include one or more other derivatives of DMTD, such as a carboxylic ester in which $R^9$ and $R^{10}$ may be joined to the sulfide sulfur atom through a carbonyl group. Preparation of these thioester containing DMTD derivatives is described, for example, in U.S. Pat. No. 2,760,933. DMTD derivatives produced by condensation of DMTD with alpha-halogenated aliphatic monocarboxylic carboxylic acids having at least 10 carbon atoms are described, for example, in U.S. Pat. No. 2,836,564. This process produces DMTD derivatives wherein $R^9$ and $R^{10}$ are HOOC—CH($R^{19}$)—($R^{19}$ being a hydrocarbyl group). DMTD derivatives further produced by amidation or esterification of these terminal carboxylic acid groups may also be useful.

The preparation of 2-hydrocarbyldithio-5-mercapto-1,3,4-thiadiazoles is described, for example, in U.S. Pat. No. 3,663,561.

A particular class of DMTD derivatives may include mixtures of a 2-hydrocarbyldithio-5-mercapto-1,3,4-thiadiazole and a 2,5-bis-hydrocarbyldithio-1,3,4-thiadiazole. Such mixtures may be sold under the tradename HiTEC® 4313 and are commercially available from Afton Chemical.

Corrosion inhibitors can be used in any effective amount, but may typically be used in amounts from about 0.001 to 5.0 mass %, based on the mass of the transmission fluid, e.g., from 0.005 to 3.0 mass % or from 0.01 to 1.0 mass %.

Friction Modifiers

Friction modifiers may include derivatives of polyethylene polyamines and/or ethoxylated long chain amines. The derivatives of polyethylene polyamines may advantageously include succinimides of a defined structure or may be simple amides.

Suitable succinimides derived from polyethylene polyamines may include those of the following structure:

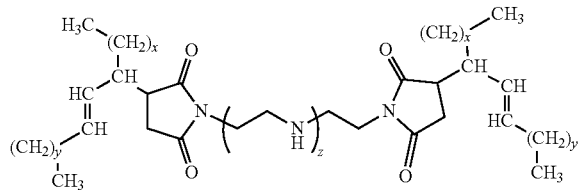

wherein x+y may be from 8 to 15 and z may be 0 or an integer from 1 to 5, in particular wherein x+y may be from 11 to 15 (e.g., 13) and z may be from 1 to 3. Preparation of such friction modifiers is described, for example, in U.S. Pat. No. 5,840,663.

The above succinimides may be post-reacted with acetic anhydride to form friction modifiers exemplified by the following structure (in which z=1):

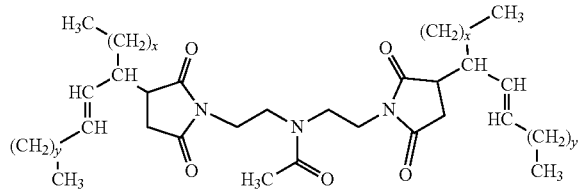

Preparation of this friction modifier, e.g., can be found in U.S. Patent Application Publication No. 2009/0005277. Post reaction with other reagents, e.g., borating agents, is also known in the art.

When present, such succinimide friction modifiers may be used in any effective amount. Typically, they may be used in amounts from 0.1 to 10.0 mass percent in the transmission fluid, e.g., from 0.5 to 6.0 mass percent or from 2.0 to 5.0 mass percent.

An example of an alternative simple amide may have the following structure:

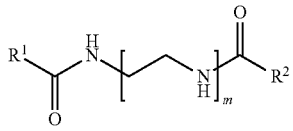

wherein $R^1$ and $R^2$ may be the same or different alkyl groups. For example, $R^1$ and $R^2$ may be $C_{14}$ to $C_{20}$ alkyl groups, which may be linear or branched, and m can be an integer from 1 to 5. In particular, $R^1$ and $R^2$ may both be derived from iso-stearic acid, and m may be 4.

When present, such simple amide friction modifiers may be used in any effective amount. Typically, they may be used in amounts from 0.1 to 5.0 mass percent in the transmission fluid, e.g., from 0.2 to 4.0 mass percent or from 0.25 to 3.0 mass percent.

Suitable ethoxylated amine friction modifiers may include or be reaction products of primary amines and/or diamines with ethylene oxide. The reaction with ethylene oxide may be suitably carried out using a stoichiometry such that substantially all primary and secondary amines may be converted to tertiary amines. Such amines may have the exemplary structures:

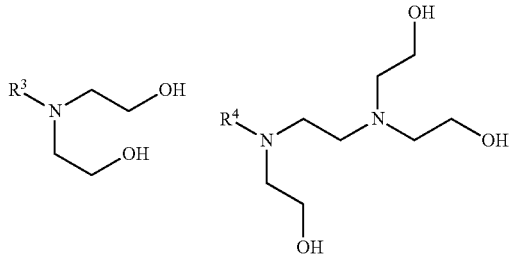

wherein $R^3$ and $R^4$ may be alkyl groups, or alkyl groups containing sulfur or oxygen linkages, containing from about 10 to 20 carbon atoms. Exemplary ethoxylated amine friction modifiers may include materials in which $R^3$ and/or $R^4$ may contain from 16 to 20 carbon atoms, e.g., from 16 to 18 carbon atoms. Materials of this type may be commercially available and sold under the tradenames of Ethomeen® and Ethoduomeen® by Akzo Nobel. Suitable materials from Akzo Nobel may include Ethomeen® T/12 and Ethoduomeen® T/13, inter alia.

When present, such ethoxylated amines may be used in any effective amount. Typically, they may be used in amounts from about 0.01 to 1.0 mass percent in the transmission fluid, e.g., from 0.05 to 0.5 mass percent or from 0.1 to 0.3 mass percent.

However, in some embodiments, particularly in embodiments in which the transmission fluid compositions are used in conjunction with hybrid or fully electric engines, the transmission fluid compositions may optionally contain substantially no friction modifiers, or alternatively substantially no friction modifiers of the type(s) described herein.

Other Additives

Other additives known in the art may optionally be added to the transmission fluids, such as other anti-wear agents, extreme pressure additives, viscosity modifiers, and the like. They are typically disclosed in, for example, "Lubricant Additives" by C. V. Smallheer and R. Kennedy Smith, 1967, pp 1-11.

Transmission Fluid Composition

As mentioned herein, transmission fluid compositions according to the present disclosure may advantageously contain a major amount of a lubricating oil basestock and a minor amount of a combination of additives, such as in an additive package, comprising Components (i), (ii), (iii), (iv), and optionally co-additives, such as an (ashless) dispersant, one or more antioxidants, one or more friction modifiers, and a (calcium-containing and/or overbased) detergent, as well as others enumerated herein. Such transmission fluid compositions may advantageously be useful in controlling and/or reducing wear during operation of vehicle drivetrain components, such as manual transmissions. As such, the present disclosure also includes a method of controlling and/or reducing wear in a manual transmission, the method comprising lubricating the manual transmission with a transmission fluid composition according to the present disclosure. Further, the present disclosure further provides for the use of a transmission fluid composition according to the present disclosure, or more specifically the use of an additive package containing the combination of Components (i), (ii), (iii), and (iv) in a transmission fluid composition to control and/or reduce wear in a manual transmission lubricated by the transmission fluid composition.

The transmission fluid composition may advantageously exhibit good/superior wear properties, when used as a lubricant. In particular, in a 4-ball wear test according to ASTM D4172, the composition may exhibit one, some, or all of the following properties. The composition may exhibit an average wear scar after about 1 hour test duration of 0.40 mm or less, e.g., of 0.36 mm or less, of 0.35 mm or less, of 0.33 mm or less, or of 0.31 mm or less. The composition may exhibit an average wear scar after about 2 hours test duration of less than 0.48 mm, e.g., less than 0.44 mm, less than 0.40 mm, less than 0.37 mm, or less than 0.35 mm. The composition may exhibit an average wear scar after about 1 hour and/or about 2 hours test duration that can be at least 10% smaller, e.g., at least 15% smaller, at least 20% smaller, at least 25% smaller, at least 35% smaller, or at least 45% smaller, than exhibited by the same composition except containing only two or only three of components (i), (ii), (iii), and (iv).

Additionally or alternatively, in particular, compounds of structure (I) (Component (i)), compounds of structure (II) (Component (ii)), and compounds of Component (iii) may be collectively present in the transmission fluid composition in an amount effective to provide the transmission fluid with from 400 to 5000 parts per million by mass of phosphorous, based on the total mass of the composition, from 600 to 3300 ppm, from 900 to 2700 ppm, or from 1000 to 2300 ppm.

Further additionally or alternatively, when boron is present in the transmission fluid composition such as through boration of any (ashless) dispersants that may be included, the transmission fluid composition may exhibit, in particular, from 15 to 180 parts per million by mass of boron, based on the total mass of the composition, from 20 to 150 ppm, from 25 to 130 ppm, or from 30 to 120 ppm.

Additional Embodiments

Additionally or alternatively, the present disclosure may include one or more of the following embodiments.

Embodiment 1

A transmission fluid composition comprising: a major amount of a lubricating oil basestock; and a minor amount of an additive package comprising: (i) a mixture comprising two or more compounds of structures (I):

(I)

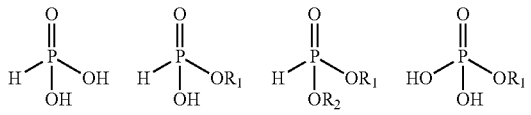

-continued

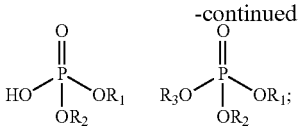

where groups $R_1$, $R_2$ and $R_3$ are independently alkyl groups having 1 to 18 carbon atoms or alkyl groups having 1 to 18 carbon atoms where the alkyl chain is interrupted by a thioether linkage, provided that, in the mixture (i), at least some of groups $R_1$, $R_2$ and $R_3$ are alkyl groups having 1 to 18 carbon atoms where the alkyl chain is interrupted by a thioether linkage; (ii) one or more compounds of structures (II):

$$R_4—S—R_5—O—R_7$$

$$R_4—S—R_5—O—R_6—S—R_7 \quad \text{(II)}$$

where groups $R_4$ and $R_7$ are independently alkyl groups having 1 to 12 carbon atoms and $R_5$ and $R_6$ are independently alkyl linkages having 2 to 12 carbon atoms; (iii) one or more zinc dihydrocarbyl dithiophosphate compounds; and (iv) one or more oil-soluble or dispersible molybdenum-containing compounds.

Embodiment 2

A transmission fluid composition according to embodiment 1, wherein the compounds of component (i) and component (ii) are each present in the composition in an amount from 0.1 to 2.0% by mass, or from 0.1 to 1.2% by mass, or from 0.1 to 0.8% by mass, or from 0.2 to 0.6% by mass, based on the total mass of the composition.

Embodiment 3

A transmission fluid composition according to embodiment 1 or embodiment 2, wherein the compounds of component (i) and component (ii) are present in the composition in a mass ratio of from 2:1 to 1:2, or from 3:2 to 2:3, or from 4:3 to 3:4.

Embodiment 4

A transmission fluid composition according to any preceding embodiment, wherein component (iii) is present in the composition in an amount from 0.4 to 5.0% by mass, or from 0.6 to 3.5% by mass, or from 1.0 to 3.0% by mass, or from 1.2 to 2.5% by mass, based on the total mass of the composition.

Embodiment 5

A transmission fluid composition according to any preceding embodiment, wherein component (iii) provides the composition with 400 to 4500 parts per million by mass (ppm) of zinc, or from 500 to 2500 ppm of zinc, or from 750 to 2000 ppm of zinc, or from 800 to 1600 ppm of zinc, based on the total mass of the composition.

Embodiment 6

A transmission fluid composition according to any preceding embodiment, wherein component (iv) is present in the composition in an amount from 0.1 to 2.0% by mass, or from 0.1 to 1.5% by mass, or from 0.2 to 1.2% by mass, or from 0.2% to 0.8% by mass, based on the total mass of the composition.

Embodiment 7

A transmission fluid composition according to any preceding embodiment, wherein component (iv) provides the composition with from 50 to 1000 parts per million by mass (ppm) of molybdenum, or from 50 to 800 ppm of molybdenum, or from 100 to 650 ppm of molybdenum, or from 100 to 500 ppm of molybdenum, based on the total mass of the composition.

Embodiment 8

A transmission fluid composition according to any preceding embodiment, wherein component (iv) comprises a molybdenum dithiocarbamate, a molybdenum dialkyldithiophosphate, a molybdenum alkyl xanthate, a molybdenum alkyl thioxanthate, or a combination thereof.

Embodiment 9

A transmission fluid composition according to any preceding embodiment, wherein component (iv) comprises substantially no molybdenum dialkyldithiophosphate.

Embodiment 10

A transmission fluid composition according to any preceding embodiment, wherein component (iv) is a di-nuclear or a tri-nuclear molybdenum compound.

Embodiment 11

A transmission fluid composition according to any preceding embodiment, further comprising one or more ashless dispersants, a calcium-containing detergent, or a combination thereof.

Embodiment 12

A transmission fluid composition according to any preceding embodiment, wherein the lubricating oil basestock is a Group 11 basestock, a Group III basestock, or a combination thereof.

Embodiment 13

A transmission fluid composition according to any preceding embodiment, wherein one or more of the following are satisfied: in a 4-ball wear test according to ASTM D4172, the composition exhibited an average wear scar after about 1 hour test duration of 0.35 mm or less; in a 4-ball wear test according to ASTM D4172, the composition exhibited an average wear scar after about 2 hours test duration of less than 0.40 mm; and in a 4-ball wear test according to ASTM D4172, the composition exhibited an average wear scar after about 1 hour and/or about 2 hours test duration that was at least 20% smaller than exhibited by the same composition except containing only two or only three of components (i), (ii), (iii), and (iv).

Embodiment 14

A transmission fluid composition according to any preceding embodiment, wherein the composition consists essentially of: from 75 to 97%, based on the weight of the composition, of a lubricating oil basestock exhibiting a kinematic viscosity at 100° C. (KV100), as measured by ASTM D445, from 2 cSt to 10 cSt; and from 2.4 to 24%, based on the weight of the composition, of an additive package consisting essentially of: (i) from 0.1 to 2.0% by mass, or from 0.1 to 1.2% by mass, or from 0.1 to 0.8% by mass, or from 0.2 to 0.6% by mass, based on the total mass of the composition, of a mixture comprising two or more compounds of structures (I):

(I)

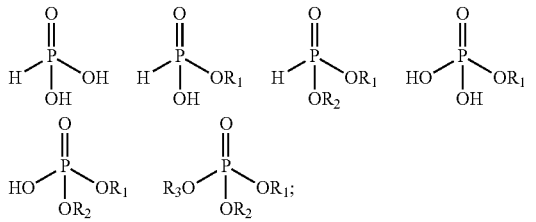

where groups $R_1$, $R_2$ and $R_3$ are independently alkyl groups having 1 to 18 carbon atoms or alkyl groups having 1 to 18 carbon atoms where the alkyl chain is interrupted by a thioether linkage, provided that, in the mixture (i), at least some of groups $R_1$, $R_2$ and $R_3$ are alkyl groups having 1 to 18 carbon atoms where the alkyl chain is interrupted by a thioether linkage; (ii) from 0.1 to 2.0% by mass, or from 0.1 to 1.2% by mass, or from 0.1 to 0.8% by mass, or from 0.2 to 0.6% by mass, based on the total mass of the composition, of one or more compounds of structures (II):

$$R_4—S—R_5—O—R_7$$

$$R_4—S—R_5—O—R_6—S—R_7 \quad \text{(II)}$$

where groups $R_4$ and $R_7$ are independently alkyl groups having 1 to 12 carbon atoms and $R_5$ and $R_6$ are independently alkyl linkages having 2 to 12 carbon atoms; (iii) from 0.4 to 5.0% by mass, or from 0.6 to 3.5% by mass, or from 1.0 to 3.0% by mass, or from 1.2 to 2.5% by mass, based on the total mass of the composition, of one or more zinc dihydrocarbyl dithiophosphate compounds; (iv) from 0.1 to 2.0% by mass, or from 0.1 to 1.5% by mass, or from 0.2 to 1.2% by mass, or from 0.2% to 0.8% by mass, based on the total mass of the composition, of one or mom oil-soluble or dispersible molybdenum-containing compounds; (v) optionally an ashless dispersant; (vi) optionally one or more antioxidants; (vii) optionally one or more corrosion inhibitors; (viii) optionally one or more friction modifiers; (ix) optionally a calcium-containing detergent; and (x) optionally additional lubricating oil basestock, wherein one or more of the following are satisfied: the composition exhibits a zinc content of from 400 to 4500 ppm, or from 500 to 2500 ppm, or from 750 to 2000 ppm, or from 800 to 1600 ppm, based on the total mass of the composition; the composition exhibits a molybdenum content of from 50 to 1000 ppm, or from 50 to 800 ppm, or from 100 to 650 ppm, or from 100 to 500 ppm, based on the total mass of the composition; and the composition exhibits a phosphorus content of from 400 to 5000 ppm, or from 600 to 3300 ppm, or from 900 to 2700 ppm, or from 1000 to 2300 ppm, based on the total mass of the composition, and wherein one or more of the following are satisfied: in a 4-ball wear test according to ASTM D4172, the composition exhibited an average wear scar after about 1 hour test duration of 0.35 mm or less; in a 4-ball wear test according to ASTM D4172, the composition exhibited an average wear scar after about 2 hours test duration of less than 0.40 mm; and in a 4-ball wear test according to ASTM D4172, the composition exhibited an average wear scar after about 1 hour or about 2 hours test duration that was at least 20% smaller than exhibited by the same composition except containing only two or only three of components (i), (ii), (iii), and (iv).

Embodiment 15

A transmission fluid composition according to embodiment 14, wherein one or more of the following is satisfied: the lubricating oil basestock is a Group II basestock, a Group III basestock, or a combination thereof; the additive package comprises from 0.1 to 5% by mass of an ashless dispersant; the ashless dispersant comprises a polyisobutenyl succinimide formed from polyisobutenyl succinic anhydride and a polyalkylene polyamine, wherein the polyisobutenyl group is derived from polyisobutene and exhibits a number average molecular weight (Mn) from about 750 to about 5000 Daltons; the additive package comprises an overbased calcium-sulfonate detergent, an overbased calcium salicylate detergent, or a combination thereof, which detergent provides the transmission fluid composition with from 500 to 4500 parts per million by mass of calcium; the additive package comprises at least two antioxidants, other than any compounds that may function as antioxidants from components (i), (ii), (iii), and (iv); the additive package comprises one or more friction modifiers; the additive package comprises lubricating oil basestock, in addition to the lubricating oil basestock that forms a majority of the transmission fluid composition; and the transmission fluid composition exhibits a boron content from 15 to 180 parts per million by mass, based on the total mass of the composition.

Embodiment 16

A method of controlling or reducing wear in a manual transmission, the method comprising lubricating the transmission with a transmission fluid composition according to any preceding embodiment.

Embodiment 17

The use of a transmission fluid composition according to any preceding embodiment in a transmission fluid composition to control or reduce the wear in a transmission lubricated by the composition.

Embodiment 18

The use of the combination of: a major amount of a lubricating oil basestock; and a minor amount of an additive package comprising: (i) a mixture comprising two or more compounds of structures (I):

(I)

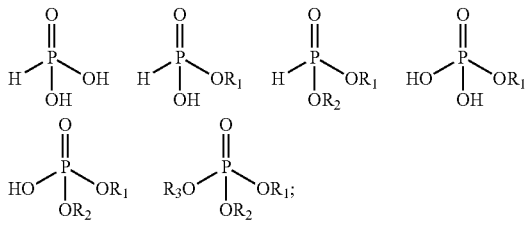

where groups $R_1$, $R_2$ and $R_3$ are independently alkyl groups having 1 to 18 carbon atoms or alkyl groups having 1 to 18 carbon atoms where the alkyl chain is interrupted by a thioether linkage, provided that, in the mixture (i), at least some of groups $R_1$, $R_2$ and $R_3$ are alkyl groups having 1 to 18 carbon atoms where the alkyl chain is interrupted by a thioether linkage; (ii) one or more compounds of structures (II):

$$R_4—S—R_5—O—R_7$$

$$R_4—S—R_5—O—R_6—S—R_7 \quad \text{(II)}$$

where groups $R_4$ and $R_7$ are independently alkyl groups having 1 to 12 carbon atoms and $R_5$ and $R_6$ are independently alkyl linkages having 2 to 12 carbon atoms; (iii) one or more zinc dihydrocarbyl dithiophosphate compounds; and (iv) one or more oil-soluble or dispersible molybdenum-containing compounds, in a transmission fluid composition to control or reduce the wear in a transmission lubricated by the composition.

The invention will now be described by way of non-limiting example only.

Examples

The following components were used to form low viscosity transmission fluid compositions according to the present disclosure.

Of the compounds representing at least 3.0 wt % of the low viscosity transmission fluid compositions according to the present disclosure, the following compounds fell within structure (I) of Component (i):

(a)

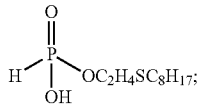

(b)

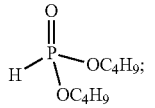

(c)

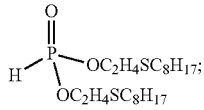

and (d)

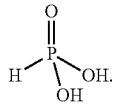

There were at least three (3) other structure (I) compounds falling within Component (i) but representing less than 3.0 wt % of the composition. Compounds (a) and (c), i.e., compounds containing an alkyl group where the alkyl chain is interrupted by a thioether linkage, collectively represented more than 40% (e.g., more than 45%) by mass of all Component (i) structure (I) compounds.

Of the compounds representing at least 3.0 wt % of the low viscosity transmission fluid compositions according to the present disclosure, the following compounds fell within structure (II) of Component (ii):

$$C_8H_{17}—S—C_2H_4—O—C_4H_9; \quad \text{(e)}$$

and $$C_8H_{17}—S—C_2H_4—O—C_2H_4—S—C_8H_{17} \quad \text{(f)}.$$

There were at least two (2) other compounds falling within structure (II) of Component (ii) but representing less than 3.0 wt % of the composition.

Component (iii) was a zinc dialkyldithiophosphate (ZDDP) where approximately 85% of the alkyl groups were secondary $C_8$ alkyl groups and the remaining ~15% were $C_2$-$C_6$ and/or $C_{10}$-$C_{18}$ alkyl groups.

Component (iv) was a tri-nuclear molybdenum dialkyldithiocarbamate where the dialkyl groups contained from 8 to 18 carbons.

A mixture of compounds of Component (i) can be prepared by placing di-butyl phosphite (~194 grams, ~2 moles) into a round-bottomed, 4-neck flask equipped with a reflux condenser, a stirring bar, and a nitrogen bubbler. The flask may then be flushed with nitrogen, sealed, and the stirrer started. The di-butyl phosphite may then be heated to ~150° C. under vacuum and maintained at temperature while hydroxyethyl n-octyl sulfide (~280 grams, ~2 moles) may be added over a period of time, such as about 1 hour. Heating may be continued following the addition of the hydroxyethyl n-octyl sulfide until butyl alcohol is no longer generated. The reaction mixture may then be cooled and the mixed product obtained.

A mixture of compounds of Component (ii) can be prepared by combining hydroxyethyl n-octyl sulfide (~190 grams, ~1 mole) and n-butyl alcohol (~74 grams, ~1 mole) in a round-bottomed, 4-neck flask equipped with an overheads receiver, a stirring bar, and a nitrogen bubbler. A catalytic amount of a suitable acid catalyst (e.g., phosphorus acid) may then be added. The flask may then be flushed with nitrogen, sealed, and the stirrer started. The reaction mixture may then be heated to ~150° C. at approximately atmospheric pressure and maintained there until ~0.5 mole of water (~9 grams) can be collected in the receiver. The reaction mixture may then be cooled to obtain the product.

Table 1 below details the transmission fluids prepared. Amounts of components (i), (ii), (iii), and (iv) are expressed in mass %, and phosphorus, sulfur, and molybdenum contents are expressed in parts per million by mass, all based on the mass of the composition. The "Other Additives" was a combination of co-additives typically found in transmission fluid compositions and included, but was not limited to, an ashless dispersant (borated), anti-oxidants, a corrosion inhibitor, friction modifiers, an overbased calcium sulfonate detergent, and a basestock oil diluent. The variation in the amount of "Other Additives" used in each example was to balance the amounts of the other components and was due only to differences in the amount of basestock oil diluent. Collectively, Components (i), (ii), (iii), and (iv), as well as the Other Additives, are referred to herein as the Additive Package. All of the active (non-diluent) components in the Additive Package were used at approximately the same concentrations in each example. The basestock oil diluent used was a Group II and/or Group III basestock with a KV100 of ~4.0 cSt ($mm^2$/sec).

TABLE 1

| Component | Example 1 | Example 2 | Example 3 | Example 4 |
|---|---|---|---|---|
| (i) structure (I) | 0.29 | 1.13 | 0.00 | 0.29 |
| (ii) structure (II) | 0.29 | 1.11 | 0.00 | 0.29 |
| (iii) ZDDP | 1.80 | 0.00 | 2.43 | 1.80 |
| (iv) Mo compound | 0.45 | 0.45 | 0.45 | 0.00 |
| Other Additives | 7.17 | 7.31 | 7.12 | 7.57 |
| Base lubricating oil | balance | balance | balance | balance |
| phosphorus [ppm] | 1880 | 1880 | 1880 | 1880 |
| zinc [ppm] | 1580 | 0 | 2140 | 1580 |
| molybdenum [ppm] | 248 | 248 | 248 | 0 |
| ~1 hr avg wear scar | 0.30 mm | 0.41 mm | 0.37 mm | 0.43 mm |
| ~2 hr avg wear scar | 0.32 mm | 0.57 mm | 0.41 mm | 0.49 mm |

Example 1 was an example utilizing all of Components (i), (ii), (iii), and (iv), whereas Examples 2, 3, and 4 utilized less than all of such components. For instance, Example 2 did not contain Component (iii) and was thus substantially zinc-free; Example 3 did not contain Components (i) and (ii), but its phosphorus level was normalized to a similar level by addition of extra Component (iii); and Example 4 did not contain Component (iv) and was thus substantially molybdenum-free.

Each composition was tested using a 4-ball wear test. This test is commonly used in the lubricants industry (ASTM D4172). The test machine utilized four ~½ inch (~1.3 cm) diameter steel balls, three of which were held in a circular cradle and remained stationary for the duration of the test. The fourth ball was held in a chuck above, and in loaded contact with, the stationary balls. The test involved lubricating the contact between the balls with the composition to be tested and then rotating the fourth ball at a specified rotational speed and for a chosen duration under an applied load. The average size of the wear scars on the stationary balls was measured at the end of the test. The size of the wear scar was taken to indicate the ability of the tested fluid to provide wear protection, with a smaller average wear scar indicating better wear protection. Tests were run at a rotational speed of ~1450 rpm under an applied load of ~300N. Wear scars were measured after ~1 hour and after ~2 hours test duration. The results are shown at the bottom of Table 1.

It is clear from the wear test results that Example 1 (containing all four components according to the present disclosure) exhibited superior wear performance. A comparison with Examples 2 and 3 shows that, at the same level of phosphorus in the composition, neither Components (i)+(ii) nor Component (iii) alone (of the phosphorus-containing components) performed as well as Example 1 containing a combination of Components (i), (ii), and (iii). Furthermore, a comparison with Example 4 showed that, absent component (iv), this synergistic behavior between the combination of Components (i)+(ii) and Component (iii) was not evident.

Three further oils were formulated as shown in Table 2 below. These were similar to those above but did not contain any Other Additives. The base lubricating oil was the same as before.

TABLE 2

| Component | Example 5 | Example 6 | Example 7 |
|---|---|---|---|
| (i) structure (I) | 0.29 | 0.29 | 0.29 |
| (ii) structure (II) | 0.29 | 0.29 | 0.29 |
| (iii) ZDDP | 1.80 | 0.00 | 1.80 |
| (iv) Mo compound | 0.45 | 0.45 | 0.00 |

TABLE 2-continued

| Component | Example 5 | Example 6 | Example 7 |
|---|---|---|---|
| Other Additives | 0.00 | 0.00 | 0.00 |
| Base lubricating oil | balance | balance | balance |
| phosphorus [ppm] | 1880 | 440 | 1880 |
| zinc [ppm] | 1580 | 0 | 1580 |
| molybdenum [ppm] | 248 | 248 | 0 |
| ~2 hr avg wear scar | 0.45 mm | 0.88 mm | 0.88 mm |

Examples 5 and 7 were repeats of Examples 1 and 4 above, but without any Other Additives. Example 6 was a repeat of Example 2 above, but with a lower concentration of Components (i) and (ii)(similar to the levels in Examples 5 and 7) and also without any Other Additives. As can be seen, Example 5 utilized all of Components (i), (ii), (iii), and (iv), whereas Example did not contain Component (iii) and was thus substantially zinc-free, and Example 7 did not contain Component (iv) and was thus substantially molybdenum-free.

These compositions were tested using the same 4-ball wear test and conditions as applied to Examples 1-4 above. The results in Table 2 show that that Example 5 (containing all four components according to the present disclosure) exhibited acceptable wear performance, even without any Other Additives typically found in transmission fluid compositions.

What is claimed is:

1. A transmission fluid composition comprising:

a major amount of a lubricating oil basestock; and a minor amount of an additive package comprising:

(i) a mixture comprising two or more compounds of structures (I):

(I)

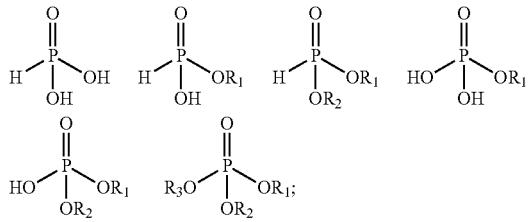

where groups $R_1$, $R_2$ and $R_3$ are independently alkyl groups having 1 to 18 carbon atoms or alkyl groups having 1 to 18 carbon atoms where the alkyl chain is interrupted by a thioether linkage, provided that, in the mixture (i), at least some of groups $R_1$, $R_2$ and $R_3$ are alkyl groups having 1 to 18 carbon atoms where the alkyl chain is interrupted by a thioether linkage;

(ii) one or more compounds of structures (II):

$$R_4—S—R_5—O—R_7$$

$$R_4—S—R_5—O—R_6—S—R_7 \quad \text{(II)}$$

where groups $R_4$ and $R_7$ are independently alkyl groups having 1 to 12 carbon atoms and $R_5$ and $R_6$ are independently alkyl linkages having 2 to 12 carbon atoms;

(iii) one or more zinc dihydrocarbyl dithiophosphate compounds; and (iv) one or more oil-soluble or dispersible molybdenum-containing compounds.

2. A transmission fluid composition according to claim 1, wherein the compounds of component (i) and component (ii) are each present in the composition in an amount from 0.1 to 2.0% by mass, based on the total mass of the composition.

3. A transmission fluid composition according to claim 1, wherein the compounds of component (i) and component (ii) are present in the composition in a mass ratio of from 2:1 to 1:2.

4. A transmission fluid composition according to claim 1, wherein the compounds of component (i) and component (ii) are each present in the composition in an amount from 0.1 to 0.8% by mass, based on the total mass of the composition, and in a mass ratio of from 4:3 to 3:4.

5. A transmission fluid composition according to claim 1, wherein component (iii) is present in the composition in an amount from 0.4 to 5.0% by mass, based on the total mass of the composition.

6. A transmission fluid composition according to claim 1, wherein component (iii) provides the composition with from 400 to 4500 parts per million by mass (ppm) of zinc, based on the total mass of the composition.

7. A transmission fluid composition according to claim 1, wherein component (iv) is present in the composition in an amount from 0.1 to 2.0% by mass, based on the total mass of the composition.

8. A transmission fluid composition according to claim 1, wherein component (iv) provides the composition with from 50 to 1000 parts per million by mass (ppm) of molybdenum, based on the total mass of the composition.

9. A transmission fluid composition according to claim 1, wherein:

component (iii) is present in the composition in an amount from 1.2 to 2.5% by mass, based on the total mass of the composition, and provides the composition with from 750 to 2000 ppm of zinc, based on the total mass of the composition; and component (iv) is present in the composition in an amount from 0.2 to 1.2% by mass, based on the total mass of the composition, and provides the composition with from 100 to 650 ppm of molybdenum, based on the total mass of the composition.

10. A transmission fluid composition according to claim 1, wherein component (iv) comprises a molybdenum dithiocarbamate, a molybdenum dialkyldithiophosphate, a molybdenum alkyl xanthate, a molybdenum alkyl thioxanthate, or a combination thereof.

11. A transmission fluid composition according to claim 1, wherein component (iv) comprises substantially no molybdenum dialkyldithiophosphate.

12. A transmission fluid composition according to claim 1, wherein component (iv) is a di-nuclear or a tri-nuclear molybdenum compound.

13. A transmission fluid composition according to claim 1, further comprising one or more ashless dispersants and a calcium-containing detergent.

14. A transmission fluid composition according to claim 1, wherein one or more of the following are satisfied:

in a 4-ball wear test according to ASTM D4172, the composition exhibited an average wear scar after about 1 hour test duration of 0.35 mm or less;

in a 4-ball wear test according to ASTM D4172, the composition exhibited an average wear scar after about 2 hours test duration of less than 0.40 mm; and in a 4-ball wear test according to ASTM D4172, the composition exhibited an average wear scar after about 1 hour or about 2 hours test duration that was at least 20% smaller than exhibited by the same composition except containing only two or only three of components (i), (ii), (iii), and (iv).

15. A transmission fluid composition according to claim 1, wherein the composition consists essentially of:

from 75 to 97%, based on the weight of the composition, of a lubricating oil basestock exhibiting a kinematic viscosity at 100° C. (KV100), as measured by ASTM D445, from 2 cSt to 10 cSt; and from 2.4 to 24%, based on the weight of the composition, of an additive package consisting essentially of:

(i) from 0.1 to 2.0% by mass, based on the total mass of the composition, of a mixture comprising two or more compounds of structures (I):

(I)

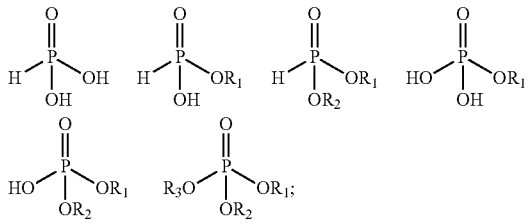

where groups $R_1$, $R_2$ and $R_3$ are independently alkyl groups having 1 to 18 carbon atoms or alkyl groups having 1 to 18 carbon atoms where the alkyl chain is interrupted by a thioether linkage, provided that, in the mixture (i), at least some of groups $R_1$, $R_2$ and $R_3$ are alkyl groups having 1 to 18 carbon atoms where the alkyl chain is interrupted by a thioether linkage;

(ii) from 0.1 to 2.0% by mass, based on the total mass of the composition, of one or more compounds of structures (II):

$$R_4—S—R_5—O—R_7$$

$$R_4—S—R_5—O—R_6—S—R_7 \quad \text{(II)}$$

where groups $R_4$ and $R_7$ are independently alkyl groups having 1 to 12 carbon atoms and $R_5$ and $R_6$ are independently alkyl linkages having 2 to 12 carbon atoms;

(iii) from 0.4 to 5.0% by mass, based on the total mass of the composition, of one or more zinc dihydrocarbyl dithiophosphate compounds;

(iv) from 0.1 to 2.0% by mass, based on the total mass of the composition, of one or more oil-soluble or dispersible molybdenum-containing compounds;

(v) optionally an ashless dispersant;

(vi) optionally one or more antioxidants;

(vii) optionally one or more corrosion inhibitors;

(viii) optionally one or more friction modifiers;

(ix) optionally a calcium-containing detergent; and (x) optionally additional lubricating oil basestock, wherein one or more of the following are satisfied:

the composition exhibits a zinc content of from 400 to 4500 ppm, based on the total mass of the composition;

the composition exhibits a molybdenum content of from 50 to 1000 ppm, based on the total mass of the composition; and the composition exhibits a phosphorus content of from 400 to 5000 ppm, based on the total mass of the composition, and wherein one or more of the following are satisfied:

in a 4-ball wear test according to ASTM D4172, the composition exhibited an average wear scar after about 1 hour test duration of 0.35 mm or less;

in a 4-ball wear test according to ASTM D4172, the composition exhibited an average wear scar after about 2 hours test duration of less than 0.40 mm; and in a 4-ball wear test according to ASTM D4172, the composition exhibited an average wear scar after about 1 hour or about 2 hours test duration that was at least 20% smaller than exhibited by the same composition except containing only two or only three of components (i), (ii), (iii), and (iv).

16. A transmission fluid composition according to claim 15, wherein the composition exhibits a phosphorus content of from 1000 to 2300 ppm, based on the total mass of the composition.

17. A transmission fluid composition according to claim 15, wherein one or more of the following is satisfied:

the lubricating oil basestock is a Group II basestock, a Group III basestock, or a combination thereof;

the additive package comprises from 0.1 to 5% by mass of an ashless dispersant;

the ashless dispersant comprises a polyisobutenyl succinimide formed from polyisobutenyl succinic anhydride and a polyalkylene polyamine, wherein the polyisobutenyl group is derived from polyisobutene and exhibits a number average molecular weight (Mn) from about 750 to about 5000 Daltons;

the additive package comprises an overbased calcium-sulfonate detergent, an overbased calcium salicylate detergent, or a combination thereof, which detergent provides the transmission fluid composition with from 500 to 4500 parts per million by mass of calcium;

the additive package comprises at least two antioxidants, other than any compounds that may function as antioxidants from components (i), (ii), (iii), and (iv);

the additive package comprises one or more friction modifiers;

the additive package comprises lubricating oil basestock, in addition to the lubricating oil basestock that forms a majority of the transmission fluid composition; and the transmission fluid composition exhibits a boron content from 15 to 180 parts per million by mass, based on the total mass of the composition.

18. A method of controlling or reducing wear in a manual transmission, the method comprising lubricating the transmission with a transmission fluid composition according to claim 1.

19. A method of controlling or reducing wear in a manual transmission, the method comprising lubricating the transmission with a transmission fluid composition according to claim 11.

20. A method of controlling or reducing wear in a manual transmission, the method comprising lubricating the transmission with a transmission fluid composition according to claim 14.

* * * * *